United States Patent [19]

Peckinpaugh et al.

[11] 3,946,664

[45] Mar. 30, 1976

[54] PRINTER TO IDENTIFY WOUND YARN PACKAGES BEING AUTOMATICALLY DOFFED FROM WINDER

[75] Inventors: Frank Lee Peckinpaugh, Colonial Heights; Duane Rae Prior, Richmond; Kenneth Roberts Benton, Colonial Heights, all of Va.

[73] Assignee: Allied Chemical Corporation, Petersburg, Va.

[22] Filed: Nov. 27, 1974

[21] Appl. No.: 527,918

[52] U.S. Cl. ..... 101/41; 101/DIG. 3

[51] Int. Cl.[2] ..... B41F 17/10

[58] Field of Search ..... 101/333, 327, 318, 316, 101/368, 379, 380, 44, 41, 43, 42, 35, 4, 3 R, DIG. 3

[56] References Cited

UNITED STATES PATENTS

| | | | |
|---|---|---|---|
| 1,743,840 | 1/1930 | Witte | 101/4 |
| 2,348,566 | 5/1944 | Papazian | 101/3 R |
| 2,558,616 | 6/1951 | Johnson | 101/3 R |
| 2,983,219 | 5/1961 | Weissman | 101/333 X |
| 3,187,666 | 6/1965 | Pedroli | 101/327 X |

*Primary Examiner*—Clifford D. Crowder
*Attorney, Agent, or Firm*—Richard A. Anderson

[57] ABSTRACT

A printing device to identify wound yarn packages being automatically doffed from a winder. The device has a stamp with a marking end to be inked by an ink pad and is spring-loaded to strike and retract from a package for marking. A triangular shaped cam slot is used for cocking and releasing the stamp responsive to pressure contact of the device with a yarn package.

3 Claims, 6 Drawing Figures

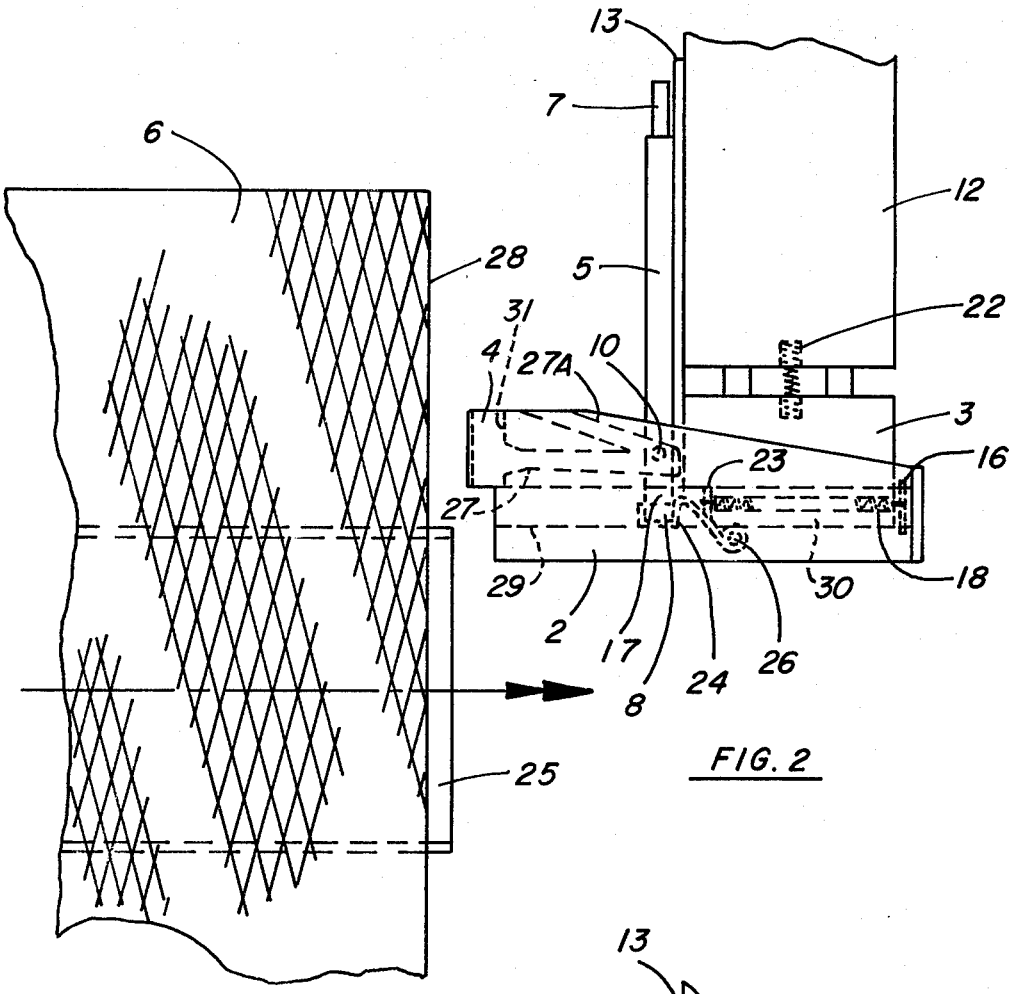
FIG. 2
FIG. 3
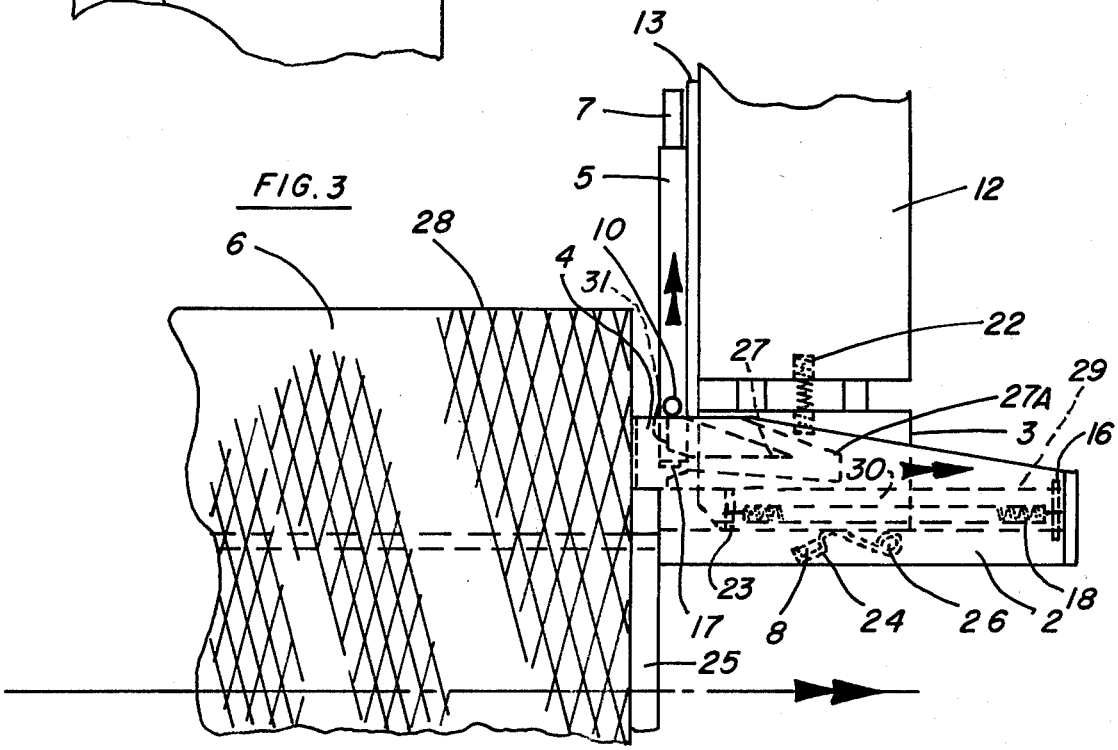

PRINTER TO IDENTIFY WOUND YARN PACKAGES BEING AUTOMATICALLY DOFFED FROM WINDER

BACKGROUND OF THE INVENTION

This invention relates to a printer to identify wound yarn packages being automatically doffed from a winder.

Presently wound yarn packages being automatically doffed from winders have to be marked by hand, defeating the purpose of automatic doffing, namely, eliminating manual handling. This problem of manual handling to mark automatically doffed packages is solved by the device of this invention.

SUMMARY OF THE INVENTION

The device of this invention is a printer to identify wound yarn packages being automatically doffed from the winder comprising in combination a support block having slidably mounted on the face thereof a stamp, and having mounted on the base thereof a guide block, and the stamp having a cam follower fixably mounted at each side, a pair of slide plates slidably mounted laterally and opposed on each side of the guide block, and having fixably mounted across the face end thereof of both slide plates a single front plate, the slide plates each having a cam slot therein, each of the cam slots facing the opposed slide plate slot and disposed to engage the cam follower on the stamp, an ink pad swingably mounted adjacent to and spring loaded toward the stamp.

The stamp has a marking means end to be inked by the ink pad. The stamp is spring-loaded to strike and retract from the package when released thereby marking and identifying the package. Each slide plate is spring loaded to urge the front plate away from the face of the guide block. The cam slot is cut so that as the slide plates slide, the stamp is raised or cocked by the cam followers on the stamp and so that as the slide plates reach the end of their travel, the stamp is released to strike and retract and thereby mark the package, and so that as the slide plate returns to the beginning position, the stamp remains at spring equilibrium position to engage the spring-loaded ink pad. Preferably, the stamp is slidably mounted to the support block by means of a fixably mounted guide having a rod slidably passing therethrough. Also, preferably the slide plates have grooves to engage a fixed guide at each side so that they slide back and forth on a fixed guide such as a bar on the base of the guide block.

The cam slot is cut with an inclined surface to guide a respective cam follower such that the first spring, meant to cock the stamp, is compressed when the slide plates are moved laterally by a package, thereby cocking the stamp, and a second surface parallel to the direction of which the stamp is biased, whereby as the slide plates reach the end of their travel by reason of contact with a package, the stamp is released to strike the package and mark it and is then retracted by a second spring, and a third surface to allow the stamp to remain at equilibrium and engage the ink pad as the slide returns to rest position when the package is removed.

BRIEF DESCRIPTION OF THE DRAWINGS

FIGS. 2, 3, 4, 5 and 6 are each a side view of the printer showing the operation of the printer of this invention as the package is automatically doffed.

DESCRIPTION OF THE PREFERRED EMBODIMENTS

Figure 1:
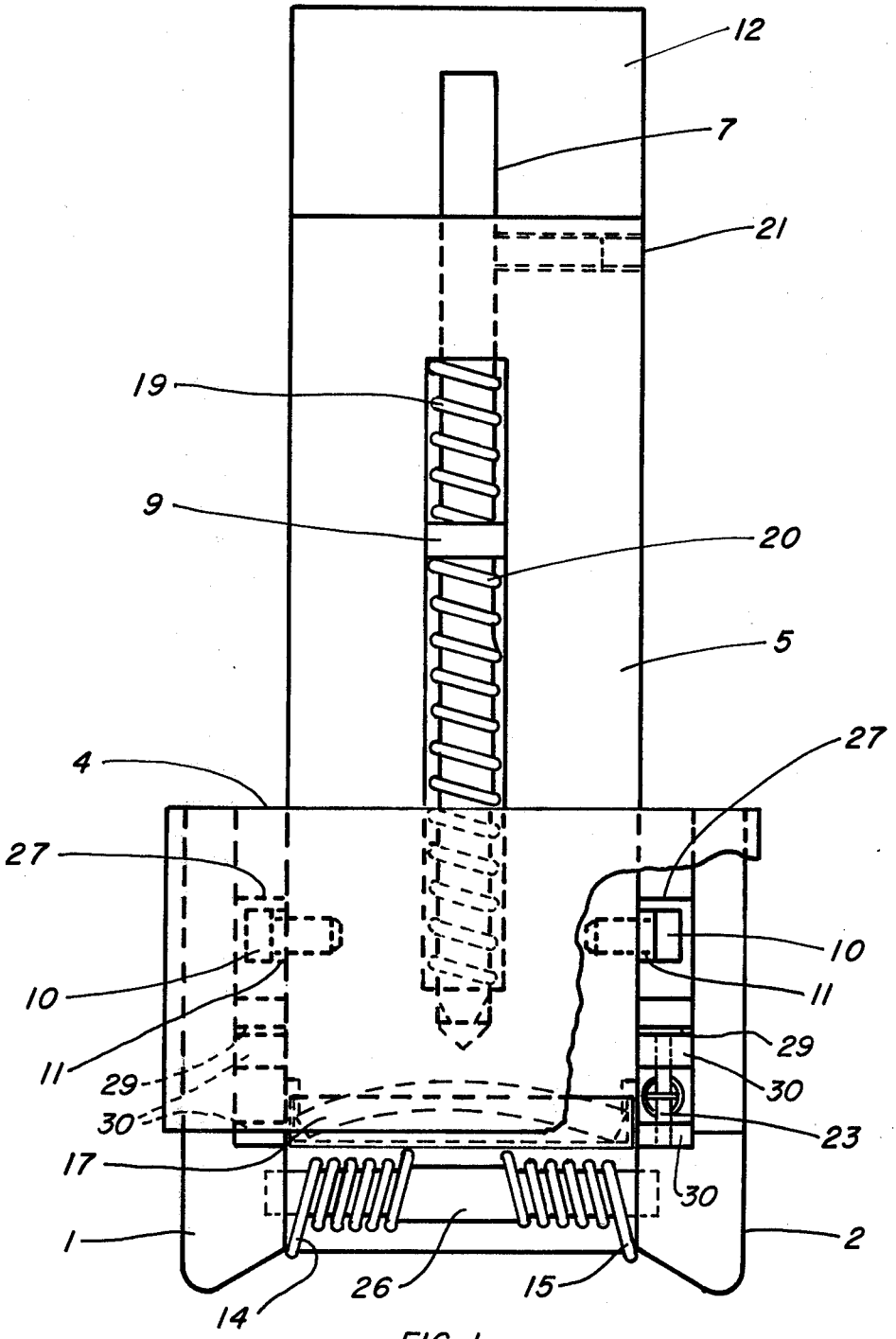
FIG. 1 is an elevation view of the printer of this invention.

FIG. 1 is an elevation view of the printer of this invention. Slide plates 1 and 2 are mounted on guide block 3 shown in FIGS. 2–6 so that they slide laterally and are opposed on each side of the guide block 3. Slide plates 1 and 2 have front plate 4 fixably mounted across the face end thereof of both slide plates 1 and 2. Guide block 3 is mounted beneath support block 12. Support block 12 has slidably mounted on the face thereof a stamp 5 which has a marking end 17. Stamp 5 is fixed to rod 7 by ball plunger 21. Rod 7 is slidably fastened to support block 12 by guide 9. Stamp 5 also has, near one end, cam followers 10 and spacer 11. Cam follower 10 follows cam slot 27 in slide plates 1 and 2. Torsion springs 14 and 15 mounted on pin 26 urge ink pad holder 24 (shown in FIGS. 2–6) upward against marking end 17. Compression springs 19 and 20 are mounted in a slot in stamp 5 restrained by the slot in stamp 5 and rigid guide 9. Also shown is roll pin 23 which fixes extension spring 18 (shown in FIGS. 2–6) to guide block 3.

Figure 4:
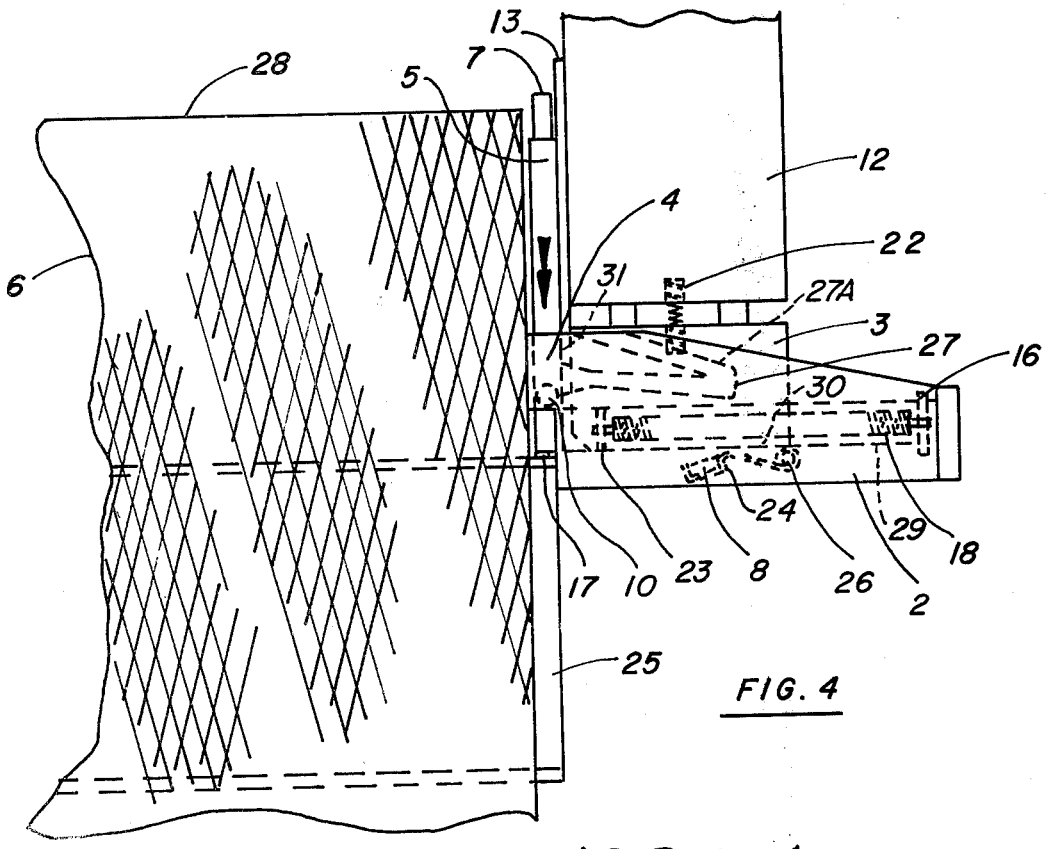
Figure 5:
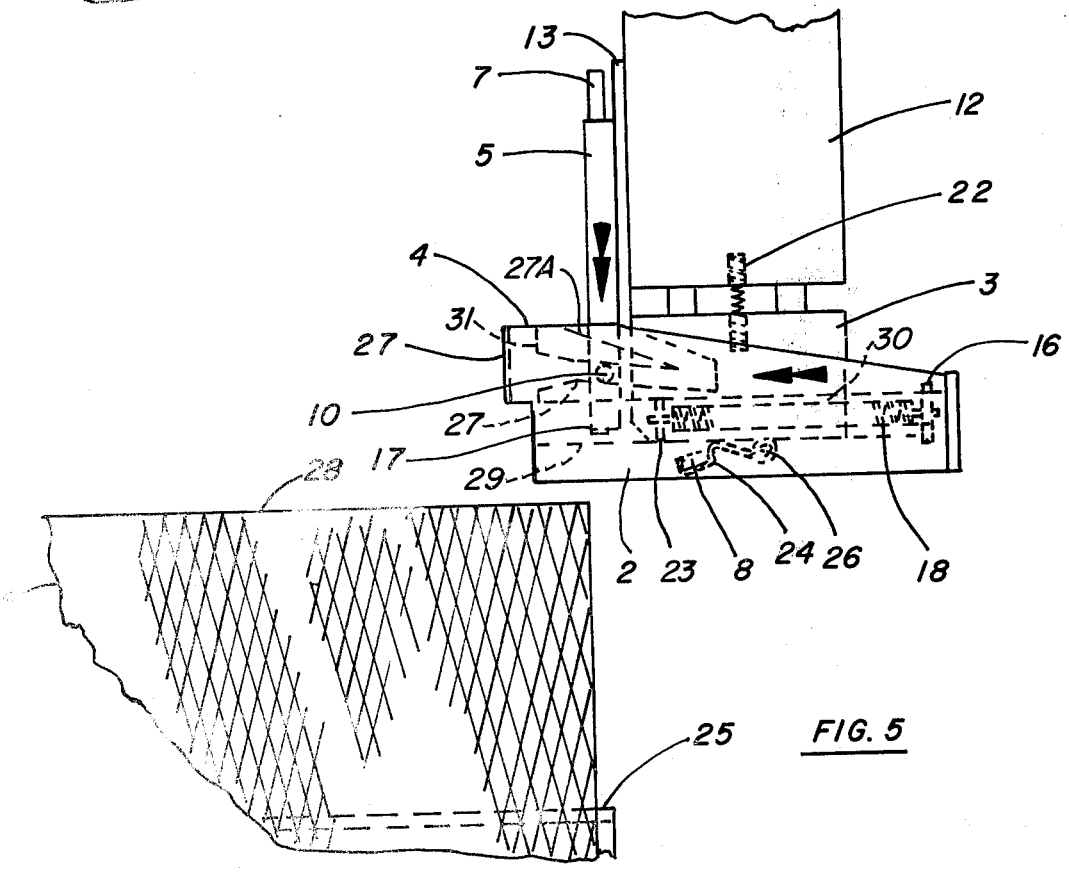
Figure 6:
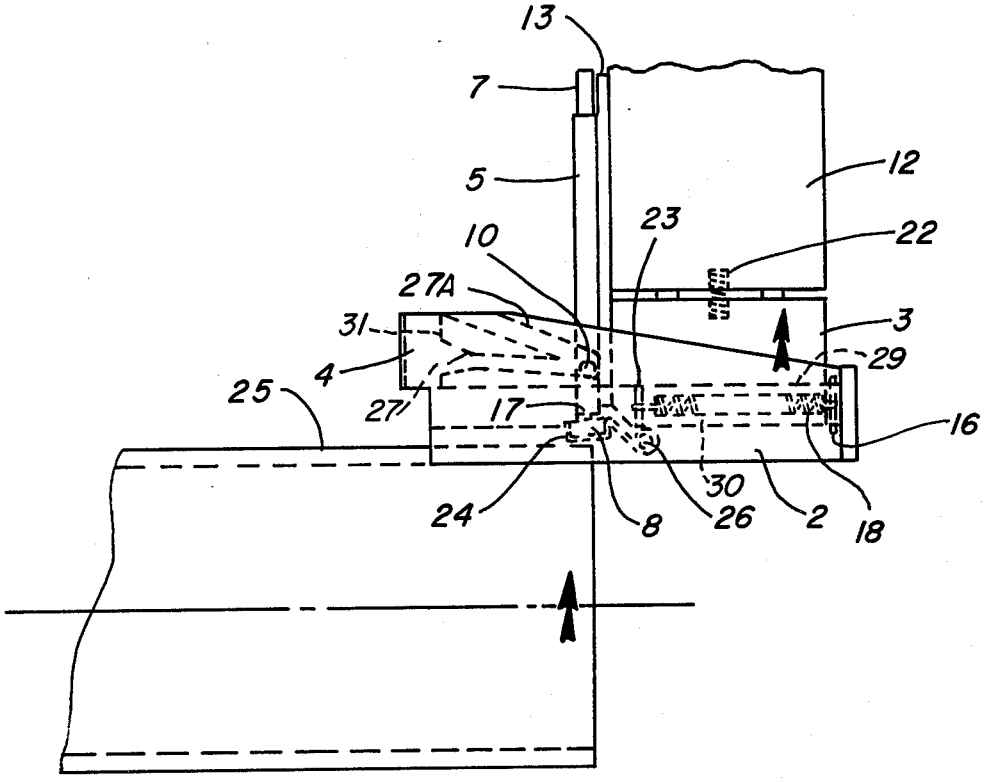

Like numbers are used to indicate identical elements in FIGS. 1–6. The following describes the elements in FIGS. 2–6. Slide plate 2 is slidably mounted on guide block 3 and has mounted thereon front plate 4. Stamp 5 is mounted on support block 12 by means of rod 7 which passes through fixed guide 9 which is fixably mounted on support block 12. Shim 13 is fixed to support block 12. Stamp 5 slides on shim 13. Cam follower 10 follows cam slot 27 in slide plate 2. Likewise cam follower 10 on the other side of stamp 5 follows a cam slot in slide plate 1. Slide plates 1 and 2 are slidably mounted on guide block 3 by means of grooves 29 which engage a fixed guide 30 at each side of support block 3 and are urged forward by extension spring 18 which is fastened to slide plates 1 and 2 by means of a pin such as 16 and to guide block 3 by means of a roll pin 23. Compression spring 22 separates guide block 3 from support block 12 and absorbs the force of any blow to the bottom of the device as shown in FIG. 6. Ink pad holder 24 containing ink pad 8 is urged against marking end 17 of stamp 5 by springs 14 and 15 shown in FIG. 1 mounted on pin 26 which is fixed to slide plates 1 and 2. In the figures yarn package 6 consists of a sleeve 25 having wound yarn 28 wound upon it.

The stamp of this invention can be used in any package being automatically doffed in a motion direction parallel to the axis of the package sleeve and then changing 90° to a motion perpendicular to axis of the package sleeve.

The action of the stamp is shown in the sequence of FIGS. 2–5.

In FIG. 2, yarn package 6 approaches the device. Note that stamp 5 is in equilibrium with both springs 19 and 20 with marking end 17 resting on ink pad 8.

In FIG. 3, package 6 continues its motion as shown by the arrow on the axis of sleeve 25. Sleeve 25 engages the end of slide plate 2 and slide plate 1 not shown. Wound yarn engages front plate 4. The motion of the package 6 causes both slide plate 1 and slide plate 2 to move in the package direction and causes cam follower 10 to follow the upper slot 27A of cam slot 27 giving the stamp 5 the motion shown by the arrow on stamp 5 to thereby cock stamp 5 by compressing compression spring 20 between guide 9 and the bottom of the slot in stamp 5.

Then in FIG. 4 as the motion continues cam follower 10 drops over the lip 31 in cam slot 27. Compression spring 20 urges stamp 5 downward so that marking end 17 strikes sleeve 25 and compresses spring 19 which retracts stamp 5 from sleeve 25 after marking it. Note in FIGS. 3 and 4 that ink pad holder 24 has been forced away from stamp 5 by the base of slide block 3.

In FIG. 5 the motion of yarn package 6 changes to transverse to the axis of sleeve 25 and thereby disengages from the device of this invention. At this time extension spring 18 which has been extended by the action of the package on the slide plates urges the slide plates in the motion shown by the arrow on slide plate 2 back toward the original position shown in FIG. 2.

FIG. 6 shows how an empty sleeve 25 moving into the printing device of this invention will fail to cock it because it would not engage face plate 4 on slide plates 1 and 2 and would simply slide beneath them. Any upward motion of the sleeve as shown by the arrows would be absorbed by spring 22 between guide block 3 and support block 12.

Thus, it can be seen that the printer of this invention eliminates hand placement of identifying tags on doffed packages from automatically doffing yarn takeup winders. It identifies the type of yarn on the package and identifies for quality control the specific production unit where the particular package was processed. This eliminates hand labor and overcomes the problem of manual handling for automatically doffed packages. The stamped strip is inked in the rest position. The device uses the package removal motion to cock and activate the mechanism. The marking end can use stamped strips which are replaceable for use with different merge or yarn identification numbers. The device can be adapted to any automatic package removal system. The device of this invention prints identifying numbers directly on the package sleeve for shipment to customers or for internal use.

We claim:

1. A printer to identify wound yarn packages being automatically doffed from a winder comprising in combination a support block having slidably mounted on the face thereof a stamp, and having mounted on the base thereof a guide block, and said stamp having a cam follower fixably mounted at each side, a pair of slide plates slidably mounted laterally and opposed on each side of said guide block, and having fixably mounted across the face end thereof of both said slide plates a single front plate, said slide plates each having a cam slot therein, disposed to engage a respective cam follower on said stamp, an ink pad swingably mounted adjacant to and spring-loaded toward said stamp, said stamp having a marking end to be inked by said ink pad, and said stamp having a first spring to bias said stamp to strike a package and a second spring to bias said stamp to retract thereby marking and identifying said package, each of said slide plates having a further spring tending to urge said front plate away from the face of said guide block into position to be contacted by a package, said cam slot being cut with an inclined surface to guide a respective cam follower such that said first spring is compressed when said slide plates are moved laterally by a package, thereby cocking said stamp, and a second surface parallel to the direction in which said stamp is biased, whereby as said slide plates reach the end of their travel by reason of contact with a package, said stamp is released to strike said package, and mark it and then retracted by said second spring, and a third surface to allow said stamp to remain at equilibrium and engage said ink pad as said slide returns to rest position when said package is removed.

2. The printer of claim 1 wherein said stamp is slidably mounted to said support block by means of a fixably mounted guide having a rod slidably passing therethrough.

3. The printer of claim 1 wherein said slide plates have grooves to engage a fixed guide at each side so that they slide back and forth on said fixed guides on the base of said guide block.

* * * * *